US005794548A

United States Patent [19]

Barlow

[11] Patent Number: 5,794,548

[45] Date of Patent: Aug. 18, 1998

[54] PNEUMATIC BARK DISTRIBUTOR FOR CONTINUOUS ASH DISCHARGE STOKERS

[75] Inventor: Dennis N. Barlow, Enfield, Conn.

[73] Assignee: Combustion Engineering, Inc., Windsor, Conn.

[21] Appl. No.: 578,006

[22] Filed: Dec. 22, 1995

[51] Int. Cl.[6] ..... F23K 3/18

[52] U.S. Cl. ..... 110/104 R; 110/115; 110/292; 414/174

[58] Field of Search ..... 110/101 R, 104 R, 110/235, 243, 244, 245, 115; 414/174

[56] References Cited

U.S. PATENT DOCUMENTS 4,326,469 4/1982 Reschly ..... 110/115

*Primary Examiner*—Henry A. Bennett
*Assistant Examiner*—Pamela A. O'Connor
*Attorney, Agent, or Firm*—Robert S. Smith, Esq.

[57] ABSTRACT

A furnace having a continuous ash discharge stoker which includes a fuel distributor apparatus for delivering associated particulate fuel to an associated continuous ash discharge furnace which includes a housing having an inlet for a particulate fuel and an inlet for pressurized air. The housing includes a surface for directing the flow of the associated particulate fuel and an outlet cooperating with the surface through which the associated particulate fuel and air exit the housing. The apparatus includes a nozzle dimensioned and configured to direct pressurized air along a face of the surface to establish a boundary layer between the surface and the associated particulate fuel flowing over the surface. In some forms of the invention the nozzle comprises first and second flat plates disposed in mutually parallel spaced relationship. The first and second flat plates may each be disposed in generally aligned relationship to at least a portion of the surface. In some forms of the invetion the apparatus includes an elongated outlet plate and the surface is on the elongated outlet plate. The outlet plate may be pivotally on an axis that may be proximate to the outlet of the nozzle and may be disposed in spaced parallel relationship to the first and second plates. The outlet plate may have an axially tapered ramp at the end of the outlet plate remote from the nozzle and the axially tapered ramp may have at least portions thereof that are laterally tapered. Some forms of the invention have an inlet for pressurized air that includes a plenum chamber through which incoming air flows before passing through the nozzle.

20 Claims, 4 Drawing Sheets

PNEUMATIC BARK DISTRIBUTOR FOR CONTINUOUS ASH DISCHARGE STOKERS

TECHNICAL FIELD

The invention has particular application to stokers for steam generating apparatus and particularly to the fuel distribution apparatus for the stoker. Modern stokers are mechanical devices which feed and burn solid fuels in a bed at the bottom of a furnace. In all cases, the fuel is burned on some form of grate, through which some or all of the air for combustion passes. The grate surface in the stationary or moving. Stokers are classified according to the way fuel is fed to the grate. The three general classes in use today are underfeed stokers, overfeed stokers, and spreader stokers.

The present invention has primary application to spreader stokers and particularly to the most popular type of spreader stokers. This type is a contiguous ash discharge (CAD) grate. The spreader stoker combines the principles of suspension burning and thin-bed combustion. Feeder/distributor devices continuously project fuel into the furnace above an ignited fuel bed on the grate. Fines are burned in suspension well larger particles fall and burn on the grate.

The spreader stoker method of fuel firing provides quick response to changes in boiler demand, and generally never has more than a few minutes of fuel inventory on the grate. The most popular type of spreader stoker is that incorporating the continuous ash discharge grate. This grate is somewhat like a continuous chain of surfaces moves toward the fuel feeders, which are throwing new fuel towards the back of the unit. All the fuel is burned before reaching the front end, from which ash is continuously dumped. The return side of the grate carries siftings, which fall through the top side, to the rear and discharges them into a hopper. The grate speed is regulated to maintain and ash bed of 2 inches to 4 inches at the discharge. Typical operating speed ranges are from 2 to 20 feet/hour.

The grate surface may be visualized as a continuous "chain" of interconnected laterally elongated bar and key assemblies. The continuous "chain" has the overall look of a wide continuous belt carried on two spaced rollers although the actual construction is closer to that of the tread on a military tank. Additional description of conventional stoker construction is provided in the handbook entitled Combustion Fossil Power, edited by Joseph G. Singer, P. E. and published by ABB Combustion Engineering, Inc. of Windsor, Conn.

Continuous ash discharge stokers are used for a wide variety of applications. They inherently are capable of firing even caking-type coals without concern about matting or clinkering. Practically all types of coal (except anthracite) and a wide variety of cellulose fuels, including wood wastes, bagasse, furfural spaced residue sludge, rice hulls, and quality grounds have been successfully burned on spreader stokers. The wood wastes may include the bark of trees. One application is in paper mills where the bark is a by-product of the paper making process. In such applications the bark is burned to produce steam. The present invention has particular application to tree bark although it may also be used with other cellulose and even other fuels.

Various pneumatic feeder/distributors for continuous ash discharge stokers are known. They have not been wholly satisfactory because, in some cases the distribution of fuel on the grate of the stoker has not been uniform. More specifically, the fuel distribution may result in piling where the fuel deposited in a number of piles or laning where the fuel is deposited in pronounced lanes. The laning is the result of uneven fuel distribution from side to side of the fuel distributor. The piling is the result of uneven distribution of the fuel between the front and rear of the grate. The uneven distribution results in unsatisfactory bed depth control, maldistribution of air under and through the grate, and uneven combustion of the fuel. Air supplied to the bottom of the grate surface will follow the path of least resistance. Thus, the air will flow to the section of the grate where there is little or no fuel coverage. High rates of burning will result in areas of reduced bed depth which will expose those areas of the grate surface resulting in overheating of the grate surface.

OBJECTS AND SUMMARY OF THE INVENTION

It is an object of the present invention to provide apparatus which provide a more even distribution of the fuel on the grate of a stoker.

Another object of the invention is to provide apparatus that will work well with cellulose fuels including tree bark.

It is an object of the invention to provide apparatus that will insure better bed depth control and more uniform burning of the fuel.

Yet another object of the present invention is to proved apparatus that will conveniently function as part of new devices as well as to facilitate retrofit installation on existing equipment.

It has now been found that these and other objects of the invention may be attained in a furnace, a continuous ash discharge stoker or a fuel distributor apparatus for delivering associated particulate fuel to an associated continuous ash discharge furnace which includes a housing having an inlet for a particulate fuel and an inlet for pressurized air. The housing includes a surface for directing the flow of the associated particulate fuel and an outlet cooperating with the surface through which the associated particulate fuel and air exit the housing. The apparatus includes a nozzle dimensioned and configured to direct pressurized air along a face of the surface to establish a boundary layer between the surface and the associated particulate fuel flowing over the surface.

In some forms of the invention the nozzle comprises first and second flat plates disposed in mutually parallel spaced relationship. The first and second flat plates may each be disposed in generally aligned relationship to at least a portion of the surface. In some forms of the invention the apparatus includes an elongated outlet plate and the surface is on the elongated outlet plate.

The outlet plate may be pivotally on an axis that may be proximate to the outlet of the nozzle and may be disposed in spaced parallel relationship to the first and second plates. The outlet plate may have an axially tapered ramp at the end of the outlet plate remote from the nozzle and the axially tapered ramp may have at least portions thereof that are laterally tapered.

Some forms of the invention have an inlet for pressurized air that includes a plenum chamber through which incoming air flows before passing through the nozzle.

BRIEF DESCRIPTION OF THE DRAWING

The invention will be better understood by reference to the accompanying drawing in which:

FIG. 6 is a sectional view taken along the line 5—5 of FIG. 1 illustrating schematically the distribution of fuel on the grate of the continuous ash discharge stoker in accordance with the present invention.

DESCRIPTION OF THE PREFERRED EMBODIMENT

Figure 1:
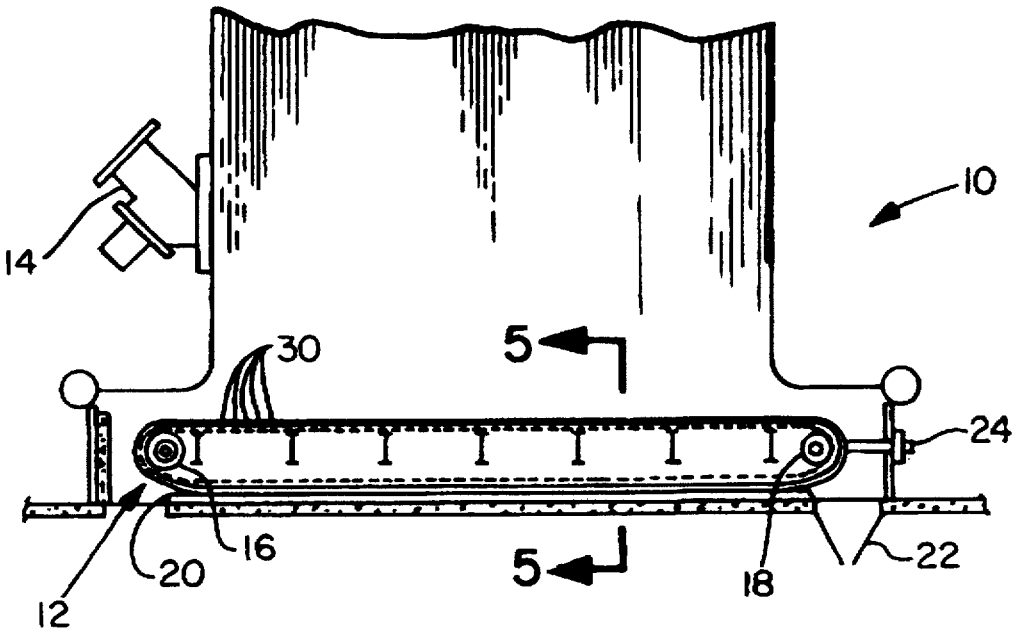
FIG. 1 is a sectional view taken along a vertical plane of a furnace incorporating a continuous ash discharge stoker in accordance with the present invention.

Referring now to FIG. 1, there is shown a steam generating furnace end incorporating a spreader stoker with a continuous ash discharge grate 12. The grate 12 is disposed at the bottom of the furnace 10. A fuel distributor 14 directs the fuel onto the upper surface of the grate 12. In a typical apparatus the fuel is distributed pneumatically onto the grate 12 near the right side (as viewed) of the upper surface of the grate 12. The grate moves counter-clockwise about the surface 16, 18. The grate 12 is supported by return rails 20. The apparatus also includes a siftings hopper 22 and a take-up 24. The sprocket 16 is mounted on a drive shaft and the sprocket 18 is mounted on an idler shaft. It will be understood that the FIG. 1 is a very simplified schematic.

The grate 12 is a continuous "chain" of interconnected laterally elongated bar and key assemblies 30. Only one end of these assemblies 30 is visible in the view of FIG. 1. It will be understood that the grate 12 includes dozens of these assemblies 30.

Figure 2:
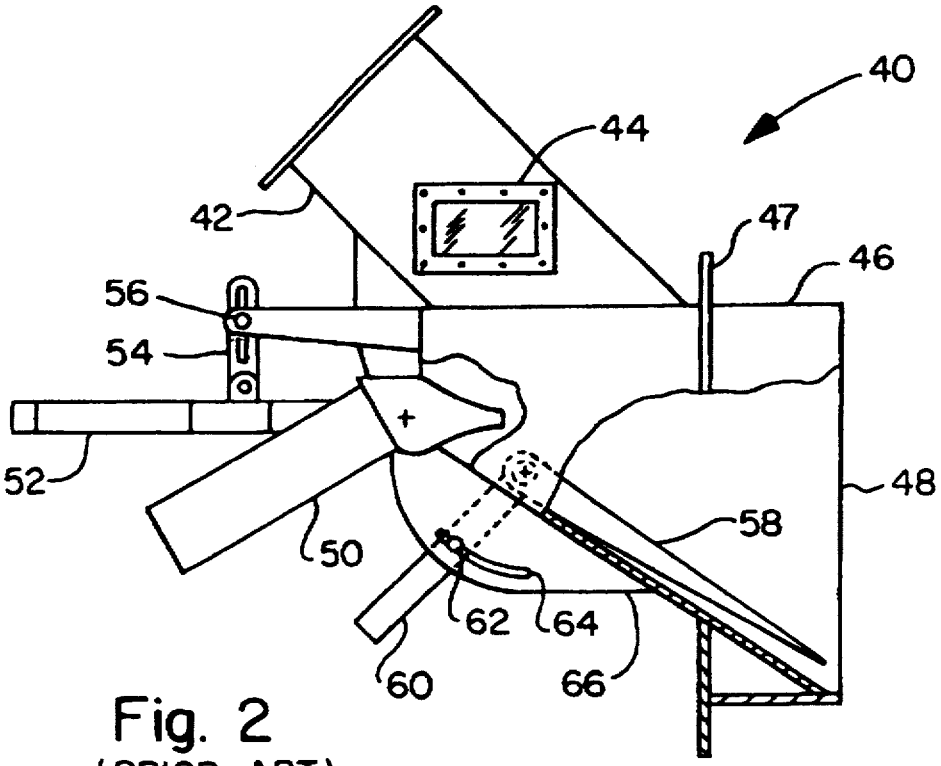
Fig. 2 (PRIOR ART)
FIG. 2 is an elevational view of a prior art fuel distributor used in the prior art continuous ash discharge stokers.

Referring now to FIG. 2 there is shown a prior art pneumatic distributor 40. An inclined inlet rectangular cross section duct or chute 42 receives fuel which moves along the duct 42 under the influence of gravity. An observation window 44 is provided in the duct 42 to allow visual inspection of the fuel flow. The duct 42 has fluid communication with the top of a housing 46. The housing 46 has an outlet 48 that is generally aligned with the inlet duct 42. Air at a pressure of approximately 30 inches of water is directed through a pivoting nozzle 50 so that the air stream disperses the fuel passing through the housing 46. The pivoting of the nozzle 50 is manipulated by a handle 52 which is locked in place by a slide 54 and thumb screw 56. A pivoting plate 58 that is manipulated by a handle 60 and locked in place by a thumb screw 62 cooperating with a slot 64 in a flange 66 carried on the housing 46. A mounting flange 47 is provided for attachment to the furnace 10.

There have been operational problems, in some cases, because the fuel, which is often mixed with sand, tends to erode the plate 58. The erosion of the plate 58 leads to unsatisfactory fuel distribution on the grate 12. More particularly, the fuel may be deposited in pronounced lanes that extend in generally parallel relation to the arrows used to identify the line 5—5. At least sometimes the fuel may be deposited on the grate 12 in piles occurring on successive axial portions of the grate 12. It will be understood that the distributor 14 throws the fuel from the left side (as viewed) of the furnace 10 to almost the right side (as viewed) of the furnace 10. Accordingly, the fuel will burn completely as it moves along the top of the grate 12 from the right side (as viewed) to the left side (as viewed).

The distribution of the fuel in piles or lanes results in a non-uniform fuel distribution which leads to non-uniform distribution of air being fed to the bottom of the upper surface of the grate flow. The under grate air will follow the path of least resistance and thus will flow to the section of the grate 12 where there is little or no fuel coverage. High rates of burning will then reduce the bed duct and expose the grate 12 surface which will lead to overheating of that section of grate 12 surface.

Figure 3:
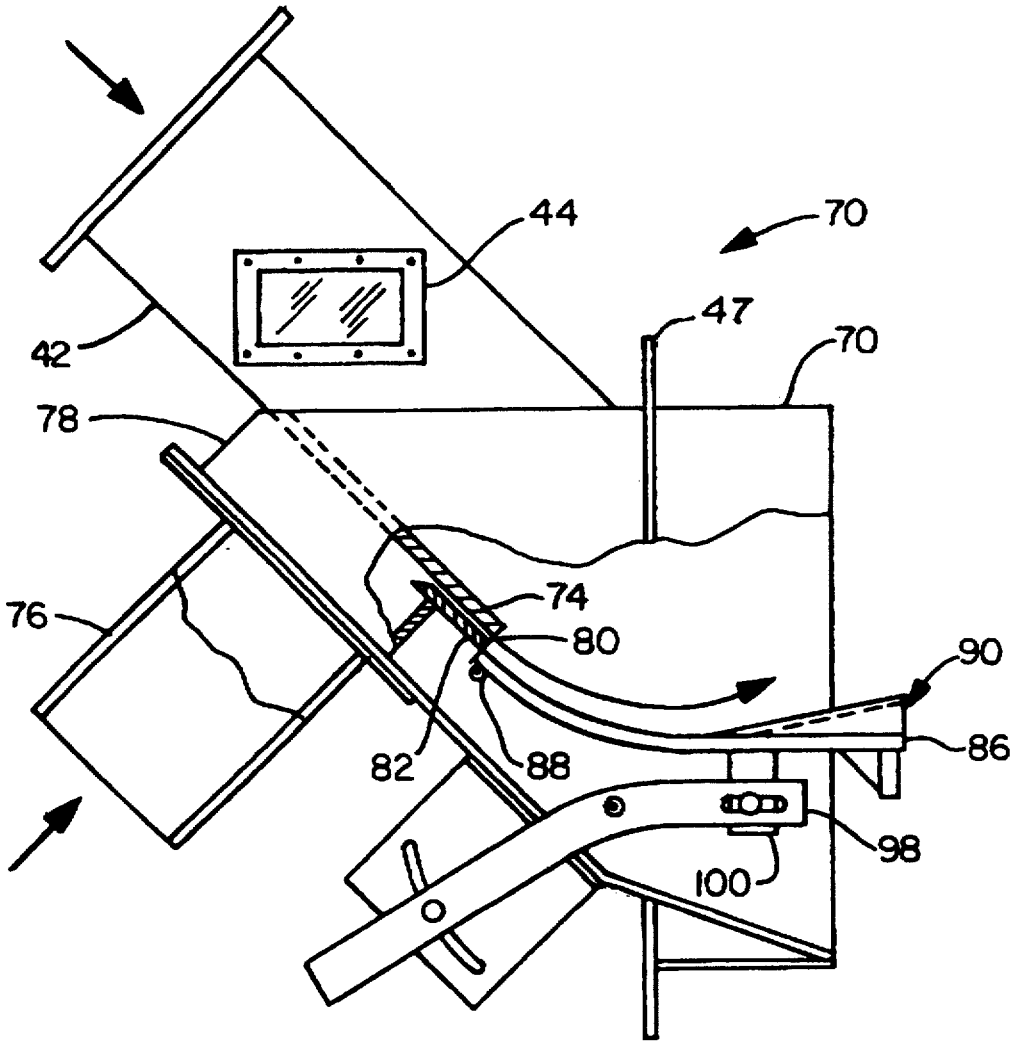
FIG. 3 is an elevational view illustrating the structure of a fuel distributor in accordance with one form of the present invention

Referring now to FIG. 3 Figure is shown a distributor 70 in accordance with a preferred form of the invention. It will be understood that the invention has been intentionally designed to permit interchangeably with the distributor 40. This design criteria is desirable for retrofit applications. The distributor 70 includes a mounting flange 47 for attachment of the housing 46 to the wall of a furnace 10. The distributor 70 includes a rectangular cross section inlet duct 42 having an observation window 44 as in the prior art structure illustrated in FIG. 2. The duct 42 has the lower (as viewed) axial extremity thereof fixed to a housing 48 that is generally similar to the housing 46.

Figure 4:
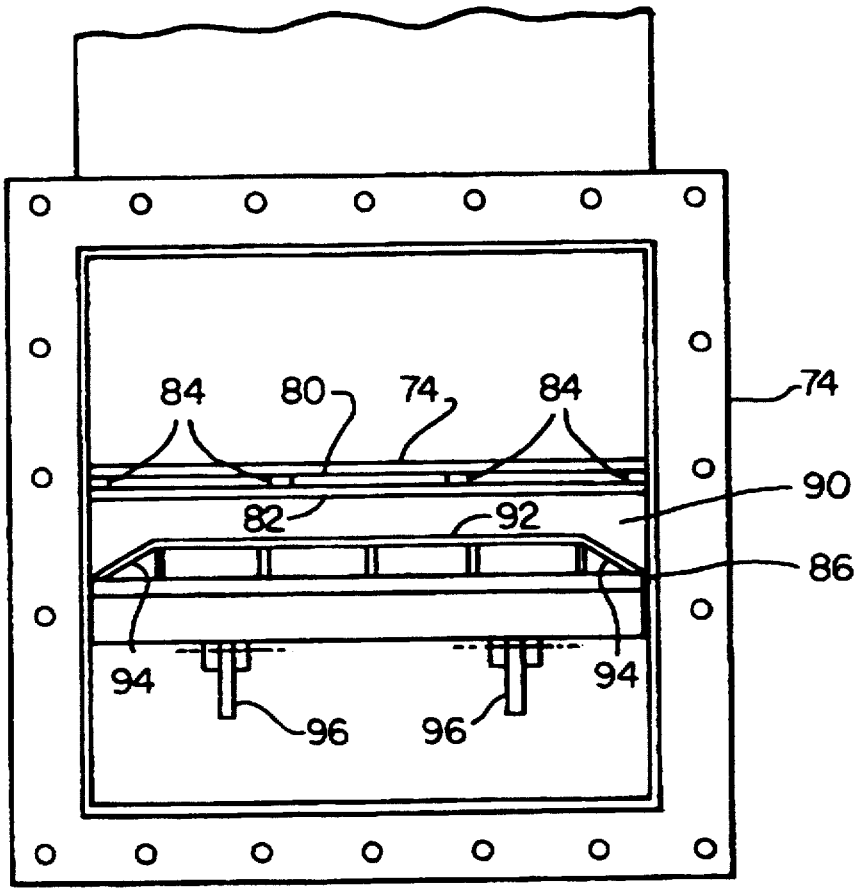
FIG. 4 is a side view of the fuel distributor illustrated in FIG. 3.

Disposed within the housing 72 is a flat plate 74 that is disposed in generally coplanar end abutting relationship to the bottom side of the duct 42. As best seen in FIG. 4 the plate 74 extends substantially the entire width of the housing 72.

An air inlet 76 is fixed to the housing 72. An associated air supply cooperates with the inlet 76 to direct air into a plenum chamber 78. The only outlet from the plenum chamber 78 is an opening 80 intermediate the plate 74 and a second plate 82. As will be apparent from FIGS. 3 and 4 the opening 80 is a slot or nozzle that extends the entire width of the housing 72 as do the plates 74 and 82. Spacers 84 are disposed at intervals between the plates 74, 82 to maintain the desired spacing necessary for fluid control.

A discharge plate 86 is carried on a hinge 88 fixed to the plate 82. The end of the discharge plate 86 fixed to the hinge 88 will be seen to be generally aligned with the nozzle formed by the plates 82 and 74. The discharge plate 86 has a ramp 90 disposed on the upper side thereof at the free end. The "free end" is the end of the ramp 90 remote from the end thereof that is fixed to the hinge 88. The ramp 90 is characterized by a central portion 92 that tapers along the axial extent of the discharge plate 86. The central portion 92 has a maximum elevation at the free end of the discharge plate 86. The ramp 90 has the end thereof nearest the free end of the discharge plate 86 laterally tapered. As best seen in FIG. 4, the sides 94, 94 of the ramp 90 are tapered from the raised central portion 92 to the surface of the discharge plate 86 at the edges of the discharge plate 86. This tapering is referred to herein as lateral tapering.

Tangs or plates 96 extend downwardly from the bottom of the discharge plate 86. A pivoted arm 98 cooperates with a pin honored carried by the plate 96 to permit manual manipulation of the location of the discharge plate 86.

In operation fuel is flowing into the duct 42 and air is flowing into the inlet 76. The passage of air out of the plenum chamber 78 through the slot 80 creates a boundary layer along the extent of the discharge plate 86 including the ramp 90. The boundary layer is of great significance because it disperses the fuel to as it passes over the ramp 90 disposed at the tip of the discharge plate 86. In addition, the boundary layer is also of great significance because it maintains more separation between the fuel and the discharge plate 86. Thus, erosion caused by the flow of fuel is greatly reduced.

Figure 5A:
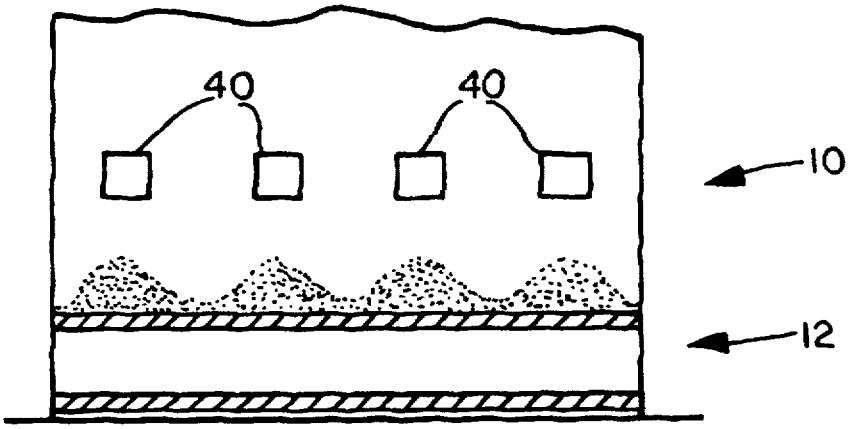
Fig. 5A (PRIOR ART)
FIG. 5 is a sectional view taken along the line 5—5 of FIG. 1 illustrating schematically the distribution of fuel on the grate of the prior art continuous ash discharge stoker.
Figure 5B:
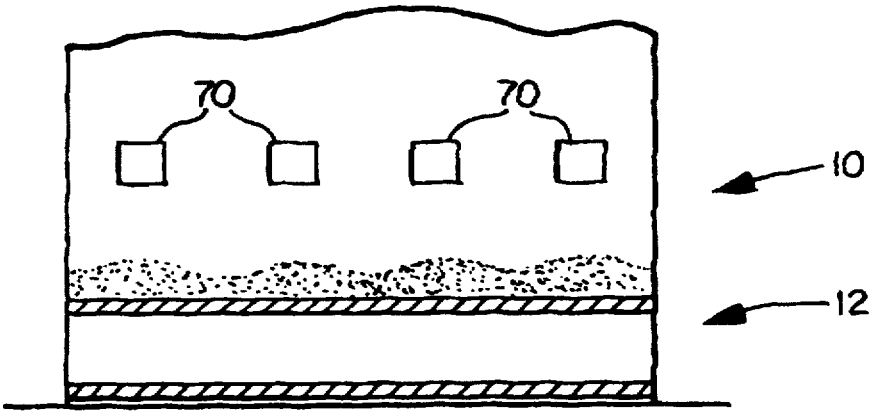

It has been found that the described shaped of the ramp 90 with the boundary layer produced by the air flowing through the slot 80 and along the surface of the discharge plate 86 produces a much more uniform fuel distribution on the grate 12. This has been illustrated schematically in FIG. 5A and FIG. 5B where the former shows the presence of pronounced lanes in which the fuel is deposited on the grate 12. FIG. 5B illustrates the more uniform distribution possible with the apparatus in accordance with the present invention. The FIGS. 5A and 5B make clear that the apparatus will typically include a plurality of laterally adjacent distributors 40 or 70.

The invention has been described with reference to its illustrated preferred embodiment. Persons skilled in the art of such devices may upon disclosure to the teachings herein, conceive other variations. Such variations are deemed to be encompassed by the disclosure, the invention being delimited only by the following claims.

Having thus described my invention, I claim:

1. A fuel distributor apparatus for delivering associated particulate fuel to an associated continuous ash discharge furnace which comprises:

a housing, said housing having an inlet for a particulate fuel and an inlet for pressurized air, said housing including a surface for directing the flow of the associated particulate fuel and an outlet cooperating with said surface through which the associated particulate fuel and air exit said housing; and means to establish a boundary layer between said surface and the associated particulate fuel flowing over said surface, said means to establish a boundary layer comprising a nozzle dimensioned and configured to direct pressurized air along a face of said surface, said nozzle comprising first and second flat plates disposed in substantially mutually parallel spaced relationship, said first and second flat plates are each disposed in substantially aligned relationship to at least a portion of said surface, said apparatus includes an elongated outlet plate and said surface is on said elongated outlet plate.

2. The apparatus as described in claim 1 wherein:

said outlet plate is pivotally mounted.

3. The apparatus as described in claim 2 wherein:

said outlet plate is pivotally mounted on an axis that is proximate to the outlet of said nozzle.

4. The apparatus as described in claim 3 wherein:

said axis is disposed in spaced parallel relationship to said first and second plates.

5. The apparatus as described in claim 4 wherein:

said outlet plate has an axially tapered ramp at the end of said outlet plate remote from said nozzle.

6. The apparatus as described in claim 5 wherein:

said axially tapered ramp has at least portions thereof that are laterally tapered.

7. The apparatus as described in claim 6 wherein:

said inlet for pressurized air includes a plenum chamber through which incoming air flows before passing through said nozzle.

8. A fuel distributor apparatus for delivering associated particulate fuel to an associated continuous ash discharge furnace which comprises:

a housing, said housing having an inlet for a particulate fuel and an inlet for pressurized air, said housing including a surface for directing the flow of the associated particulate fuel and an outlet cooperating with said surface through which the associated particulate fuel and air exit said housing; and a nozzle dimensioned and configured to direct pressurized air along a face of said surface to establish a boundary layer between said surface and the associated particulate fuel flowing over said surface, said apparatus including an elongated outlet plate and said surface is on said elongated outlet plate.

9. The apparatus as described in claim 8 wherein:

said outlet plate is pivotally mounted.

10. The apparatus as described in claim 9 wherein:

said outlet plate is pivotally mounted on an axis that is proximate to the outlet of said nozzle.

11. The apparatus as described in claim 10 wherein:

said axis is disposed in spaced parallel relationship to said first and second plates.

12. The apparatus as described in claim 11 wherein:

said outlet plate has an axially tapered ramp at the end of said outlet plate remote from said nozzle.

13. The apparatus as described in claim 12 wherein:

said axially tapered ramp has at least portions thereof that are laterally tapered.

14. A steam generating apparatus which comprises:

a furnace;

a continuous ash discharge stoker; and a fuel distributor apparatus for delivering associated particulate fuel to said continuous ash discharge stoker which includes a housing, said housing having an inlet for a particulate fuel and an inlet for pressurized air, said housing including a surface for directing the flow of the associated particulate fuel and an outlet cooperating with said surface through which the associated particulate fuel and air exit said housing; and a nozzle dimensioned and configured to direct pressurized air along a face of said surface to establish a boundary layer between said surface and the associated particulate fuel flowing over said surface, said nozzle comprising first and second flat plates disposed in mutually parallel spaced relationship, said first and second flat plates are each disposed in substantially aligned relationship to at least a portion of said surface, said apparatus includes an elongated outlet plate and said surface is on said elongated outlet plate.

15. The apparatus as described in claim 14 wherein:

said outlet plate is pivotally mounted.

16. The apparatus as described in claim 15 wherein:

said outlet plate is pivotally mounted on an axis that is proximate to the outlet of said nozzle.

17. The apparatus as described in claim 16 wherein:

said axis is disposed in spaced parallel relationship to said first and second plates.

18. The apparatus as described in claim 17 wherein:

said outlet plate has an axially tapered ramp at the end of said outlet plate remote from said nozzle.

19. The apparatus as described in claim 18 wherein:

said axially tapered ramp has at least portions thereof that are laterally tapered.

20. The apparatus as described in claim 19 wherein:

said inlet for pressurized air includes a plenum chamber through which incoming air flows before passing through said nozzle.

* * * * *